US009708167B2

(12) United States Patent
Morita et al.

(10) Patent No.: US 9,708,167 B2
(45) Date of Patent: Jul. 18, 2017

(54) INDUSTRIAL VEHICLE

(71) Applicants: KABUSHIKI KAISHA TOYOTA JIDOSHOKKI, Kariya-shi, Aichi-ken (JP); NISHINA INDUSTRIAL CO., LTD., Nagano-shi, Nagano-ken (JP)

(72) Inventors: Junichi Morita, Kariya (JP); Tetsuya Goto, Kariya (JP); Tsuyoshi Kanazawa, Nagano (JP); Yukinori Takeda, Nagano (JP)

(73) Assignees: KABUSHIKI KAISHA TOYOTA JIDOSHOKKI, Kariya-shi, Aichi-ken (JP); NISHINA INDUSTRIAL CO., LTD., Nagano-shi, Nagano-ken (JP)

( * ) Notice: Subject to any disclaimer, the term of this patent is extended or adjusted under 35 U.S.C. 154(b) by 0 days.

(21) Appl. No.: 15/225,026

(22) Filed: Aug. 1, 2016

(65) Prior Publication Data

US 2017/0036900 A1 Feb. 9, 2017

(30) Foreign Application Priority Data

Aug. 4, 2015 (JP) ..... 2015-154535

(51) Int. Cl.
*F15B 1/033* (2006.01)
*B66F 9/22* (2006.01)
(Continued)

(52) U.S. Cl.
CPC ..... *B66F 9/22* (2013.01); *F15B 1/033* (2013.01); *F15B 1/04* (2013.01); *F15B 11/17* (2013.01);
(Continued)

(58) Field of Classification Search
CPC .. F15B 1/04; F15B 11/17; F15B 1/033; F15B 13/06; B66F 9/22
(Continued)

(56) References Cited

U.S. PATENT DOCUMENTS

2012/0060777 A1* 3/2012 Tikkanen ..... F01P 7/044 123/41.11
2014/0144130 A1* 5/2014 Vigholm ..... E02F 9/2207 60/327
2014/0212305 A1* 7/2014 Krittian ..... B66F 9/22 417/364

FOREIGN PATENT DOCUMENTS

JP 2002-114499 A 4/2002

OTHER PUBLICATIONS

Communication dated Sep. 23, 2016, from the Australian Intellectual Property Office in counterpart application No. 2016208338.

* cited by examiner

*Primary Examiner* — Thomas E Lazo
(74) *Attorney, Agent, or Firm* — Sughrue Mion, PLLC

(57) ABSTRACT

An industrial vehicle includes a hydraulic brake device, a hydraulic load handling device, a first hydraulic circuit, a second hydraulic circuit, a pressure compensating circuit, and a controller. The controller sets an electromagnetic valve to a first position during operation of the load handling device. The controller sets the electromagnetic valve to a second position and controls an electric motor to drive a hydraulic pump when determining that pressure needs to be accumulated in a hydraulic accumulator based on a detection result of a detector. When the electromagnetic valve is at the second position, hydraulic pressure generated by driving the hydraulic pump is applied to a pressure compensating valve and produces a force acting in a direction to disconnect the hydraulic pump and an oil tank from each other, so that hydraulic pressure is generated in a first oil passage to be accumulated in the hydraulic accumulator.

5 Claims, 4 Drawing Sheets

(51) Int. Cl.
*F15B 1/04* (2006.01)
*F15B 11/17* (2006.01)
*F15B 13/06* (2006.01)

(52) U.S. Cl.
CPC ..... *F15B 13/06* (2013.01); *F15B 2201/51* (2013.01); *F15B 2211/20576* (2013.01)

(58) Field of Classification Search
USPC ..... 60/418
See application file for complete search history.

INDUSTRIAL VEHICLE

BACKGROUND OF THE INVENTION

The present invention relates to industrial vehicles that include a hydraulic brake device and a hydraulic load handling device.

For example, forklifts have been known as industrial vehicles with hydraulic actuators. For example, refer to Japanese Laid-Open Patent Publication No. 2002-114499. In the forklift of Japanese Laid-Open Patent Publication No. 2002-114499, pressure for actuating a hydraulic actuator is accumulated in a hydraulic accumulator. The accumulated pressure is released to actuate the actuator. The hydraulic mechanism in the forklift of the above publication employs an open center type control valve, which connects the hydraulic pump and the oil tank when actuation of the load handling device is not instructed. Thus, even if actuation of the load handling device is not instructed, pressure can be accumulated in the hydraulic accumulator by driving the hydraulic pump.

Recently, to reduce variation in the speed of load handling devices between a case in which no load is being handled and a case in which a load of the maximum loading weight is being handled, closed center type control valves have started being employed in hydraulic mechanisms. A closed center type control valve is configured to disconnect the hydraulic pump and the load handling device from each other when actuation of the load handling device is not instructed. A hydraulic mechanism that employs a closed center type control valve has a pressure compensating valve. The pressure compensating valve compensates for the working pressure of the hydraulic cylinder that actuates the load handling device. The pressure compensating valve is configured to release the pressure by discharging hydraulic oil to the oil tank when the pressure in the hydraulic circuit exceeds the relief pressure. Thus, in a hydraulic mechanism that employs a closed center type control valve, even if the hydraulic pump is driven when actuation of the load handling device is not instructed, the pressure in the hydraulic circuit is released via the pressure compensating valve, and pressure cannot be accumulated in the hydraulic accumulator. Therefore, a configuration for accumulating pressure in a hydraulic accumulator must be considered in a hydraulic mechanism employing a closed center type control valve.

SUMMARY OF THE INVENTION

Accordingly, it is an objective of the present invention to provide an industrial vehicle that is configured to maintain a pressure accumulation state of a hydraulic accumulator in a favorable manner.

To achieve the foregoing objective and in accordance with one aspect of the present invention, an industrial vehicle is provided that includes a hydraulic brake device, a hydraulic load handling device, a first hydraulic circuit, a first oil passage, a second hydraulic circuit, a second oil passage, a pressure compensating circuit, and a controller. The first hydraulic circuit includes a hydraulic accumulator, which is a hydraulic pressure source for the brake device, and a detector, which is configured to detect a pressure accumulation state of the hydraulic accumulator. The first oil passage connects the first hydraulic circuit and a hydraulic pump to each other. The second hydraulic circuit has a closed center type control valve, which disconnects the hydraulic pump and the load handling device from each other when a load manipulating section is unmanipulated.

The second hydraulic circuit switches supply/drainage of hydraulic oil by using the control valve, thereby actuating the load handling device. The second oil passage connects the second hydraulic circuit and the hydraulic pump to each other. The pressure compensating circuit has a pressure compensating valve and an electromagnetic valve. The pressure compensating valve is located in a third oil passage, which connects the hydraulic pump and the oil tank to each other without the second hydraulic pump, and the electromagnetic valve is located in a fourth oil passage, which connects the hydraulic pump and the pressure compensating valve to each other. The electromagnetic valve is configured to be switched between a first position and a second position through control by the controller. At the first position, the electromagnetic valve disconnects the hydraulic pump and the pressure compensating valve from each other, and, at the second position, the electromagnetic valve connects the hydraulic pump and the pressure compensating valve to each other. The controller is configured to set the electromagnetic valve to the first position during operation of the load handling device, and set the electromagnetic valve to the second position and control an electric motor to drive the hydraulic pump when determining that pressure needs to be accumulated in the hydraulic accumulator based on a detection result of the detector. When the electromagnetic valve is set to the second position, hydraulic pressure generated by driving the hydraulic pump is applied to the pressure compensating valve and produces a force acting in a direction to disconnect the hydraulic pump and the oil tank from each other, so that hydraulic pressure is generated in the first oil passage to be accumulated in the hydraulic accumulator.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An industrial vehicle according to one embodiment will now be described with reference to FIGS. 1 to 5.

Figure 1:
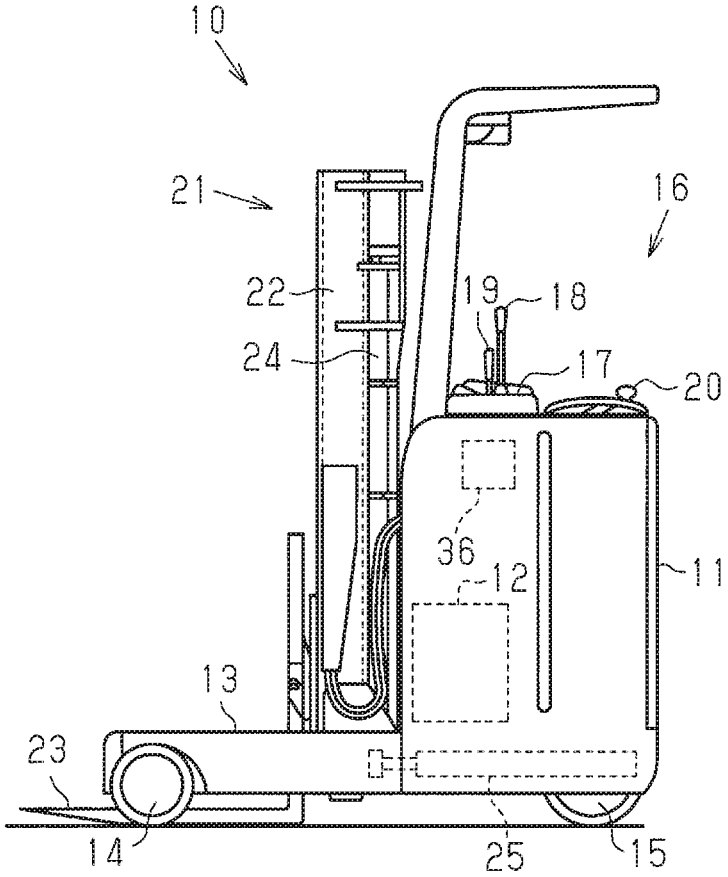
FIG. 1 is a schematic side view of a forklift.

FIG. 1 shows an industrial vehicle, which is a reach forklift 10. The forklift 10 is a three-wheel type with two coasting front wheels and a single drive rear wheel and travels by using a battery 12 accommodated in the front portion of a vehicle body 11 as a drive source (power source). Two left and right reach legs 13 extend forward from the vehicle body 11. The left and right front wheels 14 are rotationally supported at the front ends of the reach rails, which configure the left and right reach legs 13, respectively.

The single rear wheel 15 is a drive wheel, which also serves as a steerable wheel. The rear wheel 15 is offset toward the left side in the lateral direction. A caster is provided on the right side of the rear wheel 15 at a position spaced apart from the rear wheel 15 by a predetermined distance.

A standing type operator compartment 16 is provided in the rear portion of the vehicle body 11. An instrument panel 17 is provided at the front part of the operator compartment 16. Load handling levers 18 and an accelerator lever 19 are provided on the instrument panel 17. The load handling levers 18 configure a load manipulating section, and the accelerator lever 19 is used to move the forklift forward or backward. Also, a steering wheel 20 is provided in the operator compartment 16.

A hydraulic load handling device (mast assembly) 21 is provided on the front side of the vehicle body 11. The load handling device 21 includes a two-stage mast 22 and forks 23. The vehicle body 11 is provided with a plurality of hydraulic cylinders to cause the load handling device 21 to perform predetermined operations. The hydraulic cylinders include a lift cylinder 24, which lifts and lowers the mast 22, a reach cylinder 25, which moves the mast 22 forward and backward in a predetermined stroke range, and a tilt cylinder 26 (shown in FIG. 2), which tilts the mast 22 forward and backward.

Figure 2:
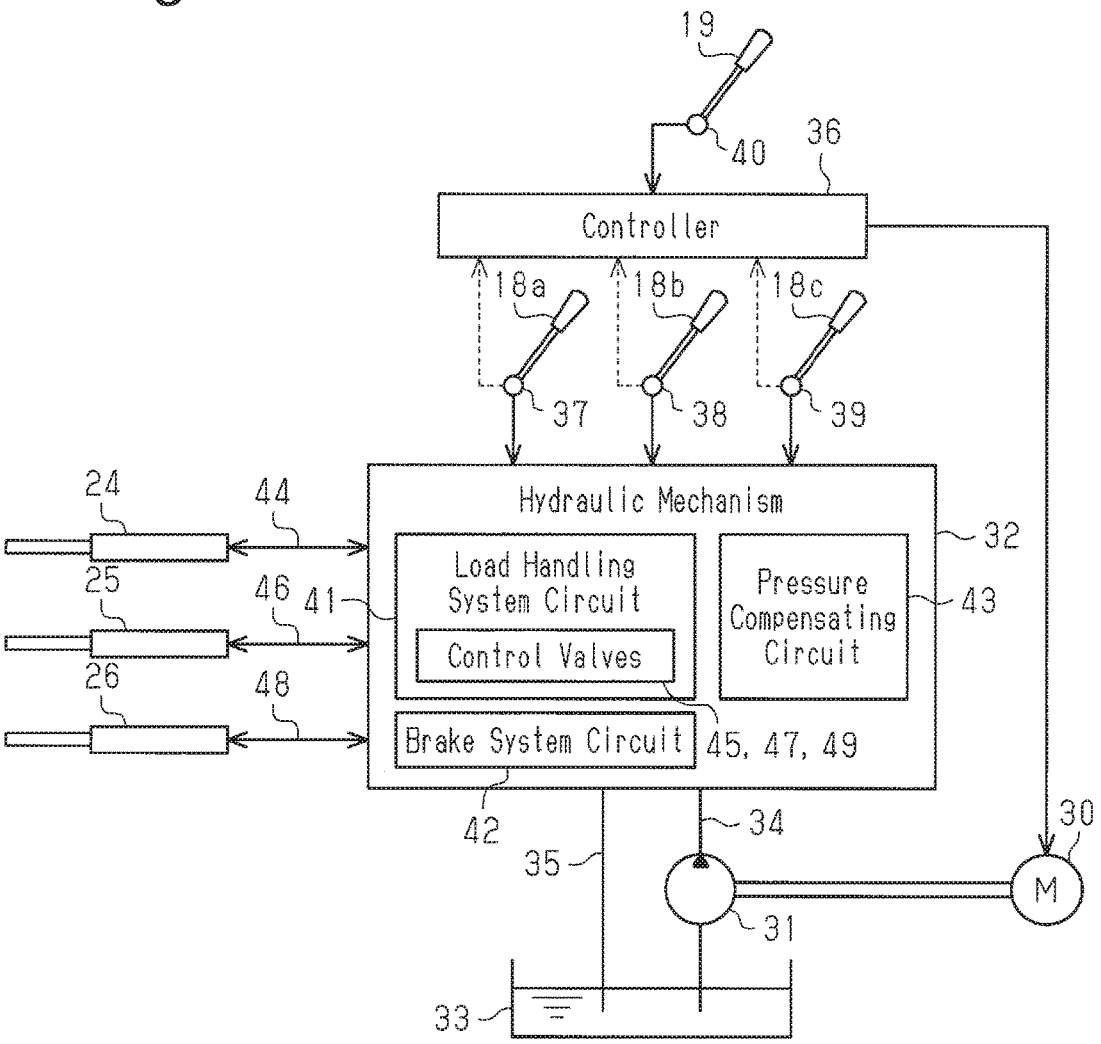
FIG. 2 is a diagram of a hydraulic mechanism.

As shown in FIG. 2, the vehicle body 11 is provided with a load handling motor 30, a hydraulic pump 31, and a hydraulic mechanism 32. The load handling motor 30 is an electric motor, which serves as the drive source for load handling operations. The hydraulic pump 31 is driven by the load handling motor 30 to discharge hydraulic oil. The discharged hydraulic oil is supplied to the hydraulic mechanism 32. The hydraulic mechanism 32 controls supply and drainage of hydraulic oil to and from the cylinders 24, 25, 26. An oil passage 34 is connected to the hydraulic pump 31. The hydraulic pump 31 draws hydraulic oil from an oil tank 33 and supplies the drawn hydraulic oil to the hydraulic mechanism 32 via the oil passage 34. The oil passage 34 is connected to the outlet of the hydraulic pump 31. An oil passage 35, via which hydraulic oil is drained to the oil tank 33, is connected to the hydraulic mechanism 32.

A controller 36 is mounted in the vehicle body 11. The controller 36 is realized, for example, by at least one dedicated hardware circuit and/or at least one processor (control circuits) that operates in accordance with a computer program (software). That is, the controller is realized by an electronic control unit having circuitry that is programmed to execute desired procedures. The processor includes a CPU and memories such as a RAM and ROM. The memories store program codes or instructions configured to cause the processor to execute processes. The memories, or computer readable media, include any type of media that are accessible by general-purpose computers and dedicated computers.

The controller 36 controls starting and stopping of the load handling motor 30, thereby controlling operation of the hydraulic pump 31. Also, the controller 36 is electrically connected to sensors that detect the operational states of the load handling levers 18. The load handling levers 18 include a lift operation lever 18*a*, a reach operation lever 18*b*, and a tilt operation lever 18*c*. The sensors include a tilt sensor 37, which detects the operational state of the lift operation lever 18*a*, a reach sensor 38, which detects the operational state of the reach operation lever 18*b*, and a tilt sensor 39, which detects the operational state of the tilt operation lever 18*c*. The lift operation lever 18*a* is used to instruct a lift operation (upward and downward motions of the mast 22). The reach operation lever 18*b* is used to instruct a reach operation (forward and backward motions of the mast 22). The tilt operation lever 18*c* is used to instruct a tilt operation (tilting motions of the mast 22). Also, the controller 36 is electrically connected to an accelerator sensor 40, which detects the amount of manipulation of the accelerator lever 19 (accelerator manipulation amount).

The structure of the hydraulic mechanism 32 will now be described.

The hydraulic mechanism 32 includes a first hydraulic circuit, which is a brake system circuit 42, and a second hydraulic circuit, which is a load handling system circuit 41, and a pressure compensating circuit 43.

The load handling system circuit 41 is a hydraulic circuit that controls hydraulic pressure for driving the load handling device 21. The load handling system circuit 41 includes a lift operation control valve 45, a reach operation control valve 47, and a tilt operation control valve 49. The lift operation control valve 45 is connected to the oil chamber of the lift cylinder 24 via an oil passage 44. The reach operation control valve 47 is connected to the oil chamber of the reach cylinder 25 via an oil passage 46. The tilt operation control valve 49 is connected to the oil chamber of the tilt cylinder 26 via an oil passage 48. The control valves 45, 47, 49 are connected to the oil passage 34, which is connected to the hydraulic pump 31, and to the oil passage 35, which is connected to the oil tank 33. The oil passage 34 functions as a second oil passage, which connects the hydraulic pump 31 and the load handling system circuit 41 to each other.

The lift operation lever 18*a* is mechanically coupled to the control valve 45, so that manipulation of the lift operation lever 18*a* switches the open/closed state of the control valve 45. The reach operation lever 18*b* is mechanically coupled to the control valve 47, so that manipulation of the reach operation lever 18*b* switches the open/closed state of the control valve 47. The tilt operation lever 18*c* is mechanically coupled to the control valve 49, so that manipulation of the tilt operation lever 18*c* switches the open/closed state of the control valve 49.

In the present embodiment, the control valves 45, 47, 49 are all closed center type switching valves, which disconnect the hydraulic pump 31 and the load handling device 21 from each other when none of the load handling levers 18 are manipulated. When any of the load handling levers 18 is manipulated, supply/drainage of pressurized oil from the hydraulic pump 31 is switched by the corresponding one of the control valve 45, 47, 49, so that the load handling device 21 is activated. For example, when the reach operation lever 18*b* is manipulated, pressurized oil from the hydraulic pump 31 is supplied to the reach cylinder 25 via the oil passage 46 connected to the control valve 47.

The brake system circuit 42 is a hydraulic circuit that controls hydraulic pressure that drives auxiliary brake devices 50, 51 (shown in FIG. 3), which are hydraulic brake devices attached to the left and right front wheels 14. In addition to the auxiliary brake devices 50, 51, the forklift 10 is provided with a main brake device (not shown). The main brake device is a rear wheel brake device that applies braking force to the rear wheel 15, and the auxiliary brake devise 50, 51 are front wheel brake devices that apply braking force to the front wheels 14. When the main brake device applies braking force to the rear wheel 15, it is determined whether it is necessary for the auxiliary brake devices 50, 51 to apply braking force. If it is necessary, the auxiliary brake devices 50, 51 are actuated. The pressure compensating circuit 43 is a circuit that controls hydraulic pressure in the hydraulic mechanism 32.

Figure 3:
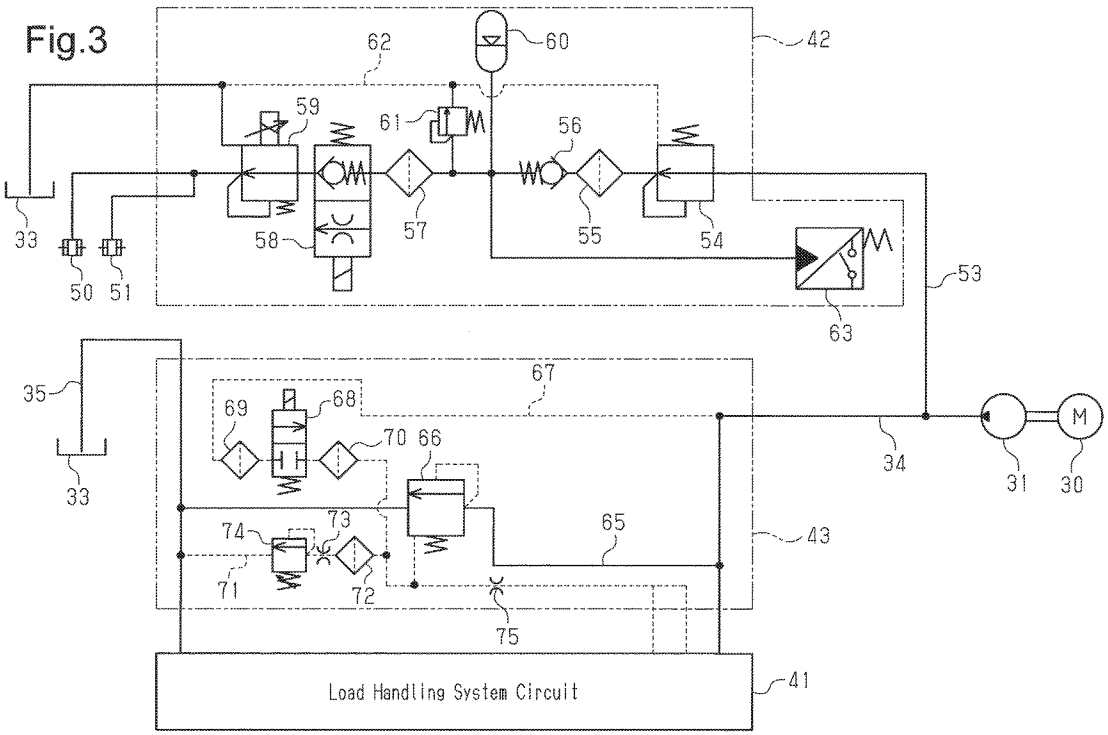
FIG. 3 is an explanatory hydraulic circuit diagram of a pressure compensating circuit and a brake system circuit.

With reference to FIG. 3, the configuration of the brake system circuit 42 and the pressure compensating circuit 43 will be described.

The brake system circuit 42 will now be described.

The brake system circuit 42 has an oil passage 53 that is connected to the auxiliary brake devices 50, 51. The oil passage 53 is connected to the hydraulic pump 31 and functions as a first oil passage, which connects the hydraulic pump 31 and the brake system circuit 42 to each other. A pressure reducing valve 54, a filter 55, a check valve 56, a filter 57, a switching valve 58, and a pressure reducing valve 59 are arranged in the oil passage 53 in that order from the side closer to the hydraulic pump 31. A hydraulic accumulator 60 is connected to a section of the oil passage 53 that is downstream of the check valve 56. The hydraulic accumulator 60 is a hydraulic pressure source for the auxiliary brake devices 50, 51 and accumulates hydraulic pressure for actuating the auxiliary brake devices 50, 51. A relief valve 61 is connected to a section of the oil passage 53 that is downstream of the section to which the hydraulic accumulator 60 is connected. The pressure reducing valves 54, 59 and the relief valve 61 are connected to an oil passage 62 connected to the oil tank 33, so that pressure is released through the pressure reducing valves 54, 59 and the relief valve 61. That is, the pressure is reduced by discharging hydraulic oil to the oil tank 33 through the pressure reducing valves 54, 59 and the relief valve 61.

The brake system circuit 42 includes a switch 63, which is a detector configured to detect the pressure accumulation state of the hydraulic accumulator 60. The switch 63 can be set to a first state or a second state in accordance with the pressure accumulation state of the hydraulic accumulator 60. The state of the switch 63 is delivered to the controller 36. In the present embodiment, the switch 63 is set to the first state (for example, the OFF state) when a predetermined pressure is accumulated in the hydraulic accumulator 60 and set to the second state (for example, the ON state) when the predetermined pressure is not accumulated in the hydraulic accumulator 60. The predetermined pressure is a value required to actuate hydraulic the auxiliary brake devices 50, 51.

The pressure compensating circuit 43 will now be described.

The pressure compensating circuit 43 has an oil passage 65 that is connected to the oil tank 33. The oil passage 65 is connected to the hydraulic pump 31 and functions as a third oil passage, which connects the hydraulic pump 31 and the oil tank 33 to each other without the load handling system circuit 41 in between. A pressure compensating valve 66 is located on the oil passage 65. The pressure compensating valve 66 generates a pressure higher than the pressure introduced to the load handling system circuit 41 from the hydraulic pump 31, thereby compensating the pressure in the load handling system circuit 41, so that a pressure required to actuate the load handling device 21 is achieved in the load handling system circuit 41. When the pressure in the load handling system circuit 41 exceeds a predetermined relief pressure, the pressure compensating valve 66 connects the hydraulic pump 31 and the oil tank 33 to each other, thereby releasing the pressure. That is, the pressure compensating valve 66 discharges hydraulic oil to the oil tank 33 to reduce the pressure.

The pressure compensating circuit 43 has an oil passage 67, which functions as a fourth oil passage that connects the hydraulic pump 31 and the pressure compensating valve 66 to each other. An electromagnetic valve (solenoid valve) 68 is located in a section of the oil passage 67 between the hydraulic pump 31 and the pressure compensating valve 66. The electromagnetic valve 68 is switched between a first position and a second position through control by the controller 36. The first position is a position at which the hydraulic pump 31 and the pressure compensating valve 66 are disconnected from each other. The second position is a position at which the hydraulic pump 31 and the pressure compensating valve 66 are connected to each other. When the electromagnetic valve 68 is set to the first position, the hydraulic pressure generated by operation of the hydraulic pump 31 is not transmitted to the pressure compensating valve 66 via the oil passage 67. When the electromagnetic valve 68 is set to the second position, the hydraulic pressure generated by operation of the hydraulic pump 31 is transmitted to the pressure compensating valve 66 via the oil passage 67. In the present embodiment, when the electromagnetic valve 68 is set to the second position, the hydraulic pressure generated by operation of the hydraulic pump 31 acts to prevent the pressure compensating valve 66 from opening the oil passage 65. That is, the hydraulic pressure is applied to the pressure compensating valve 66 and produces a force acting in a direction to disconnect the hydraulic pump 31 and the oil tank 33 from each other.

Filters 69, 70 are provided in the oil passage 67 at positions downstream of and upstream of the electromagnetic valve 68, respectively. An oil passage 71 that is connected to the oil passage 35 is connected to a section of the oil passage 67 between the electromagnetic valve 68 and the pressure compensating valve 66. A filter 72, an orifice 73, and a relief valve 74 are provided on the oil passage 71. An orifice 75 is provided on the oil passage 67 at a position closer to the load handling system circuit 41 than the section to which the pressure compensating valve 66 is connected.

Figure 4A:
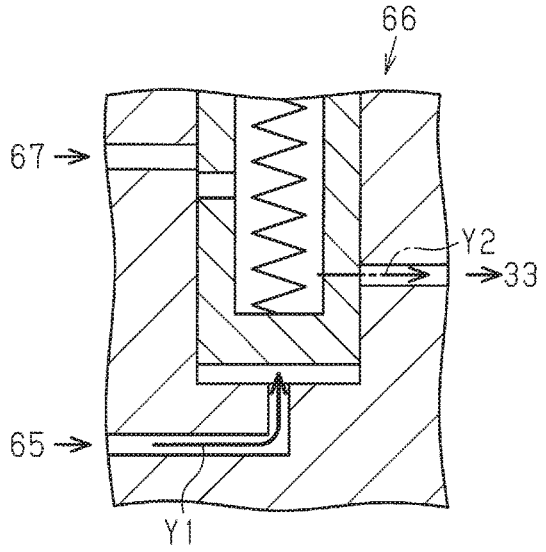
FIG. 4A is an explanatory diagram showing operation of the pressure compensating valve.
Figure 4B:
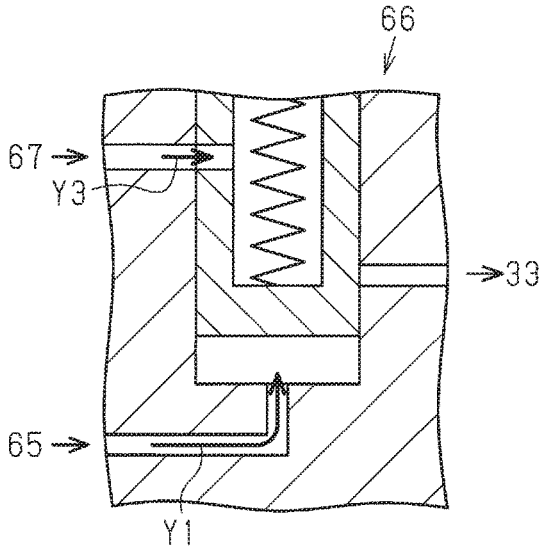
FIG. 4B is an explanatory diagram showing operation of the pressure compensating valve.
Figure 5:
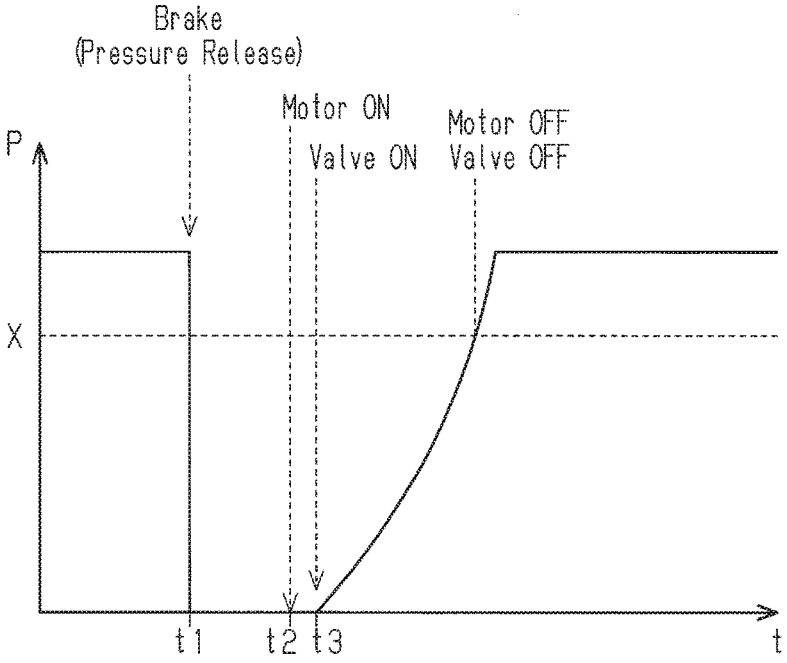
FIG. 5 is an explanatory diagram showing changes in the pressure accumulation state of the hydraulic accumulator.

With reference to FIGS. 3 to 5, operation of the hydraulic mechanism 32 mounted on the forklift 10 of the present embodiment, particularly, operation of the brake system circuit 42 and the pressure compensating circuit 43 will now be described.

When actuating the load handling device 21, the controller 36 controls the load handling motor 30 to drive the hydraulic pump 31, such that the load handling device 21 is actuated at a speed corresponding to the amount of manipulation of the load handling levers 18. Accordingly, the hydraulic pressure generated by operation of the hydraulic pump 31 is applied to the load handling system circuit 41, and the control valves 45, 47, 49 switch supply/drainage of the pressurized oil, so that the load handling device 21 performs a desired load handling operation. The hydraulic pressure generated by operation of the hydraulic pump 31 is applied to the brake system circuit 42 via the oil passage 53 and accumulated in the hydraulic accumulator 60. The check valve 56 maintains the pressure accumulated in the hydraulic accumulator 60 so that the pressure does not flow back to the hydraulic pump 31 via the oil passage 53. The electromagnetic valve 68 of the pressure compensating circuit 43 is normally set to the first position and is controlled not to apply pressure to the pressure compensating valve 66 via the oil passage 67 when the load handling device 21 is in operation.

FIG. 4A schematically shows operation of the pressure compensating valve 66 when the electromagnetic valve 68 of the pressure compensating circuit 43 is set to the first position. When the electromagnetic valve 68 is set to the first position, the pressure compensating valve 66 receives a pressure indicated by arrow Y1 of a solid line via the oil passage 65. If the pressure is not exceeding the relief pressure, the pressure compensating valve 66 uses hydraulic pressure supplied by a hydraulic cylinder via an oil passage (not shown) and the force of spring to generate a pressure that is higher than the pressure supplied to the load handling system circuit 41. In contrast, when receiving a pressure higher than the relief pressure via the oil passage 65, the pressure compensating valve 66 connects the hydraulic pump 31 and the oil tank 33 to each other, that is, opens the oil passage 65. When opening the oil passage 65, the pressure compensating valve 66 moves the piston at the position to disconnect the hydraulic pump 31 and the oil tank 33 from each other (indicated by the solid line in the drawing) in a direction to connect these (upward as viewed in the drawing) to each other. Accordingly, the pressure applied to the pressure compensating valve 66 via the oil passage 65 is released when the hydraulic oil is discharged to the oil tank 33 as indicated by arrow Y2 of a long dashed double-short dashed line.

When applying braking force to the forklift 10, the braking force is applied mainly by the rear wheel brake device. For example, when skidding of the rear wheel 15 is detected, the auxiliary brake devices 50, 51 are also actuated to apply braking force. At this time, the controller 36 controls the switching valve 58 to release the pressure accumulated in the hydraulic accumulator 60. Accordingly, the pressure from the hydraulic accumulator 60 is applied to the auxiliary brake devices 50, 51, which in turn generate braking force.

When, for example, the load handling device 21 is operating, continuous actuation of the auxiliary brake devices 50, 51 results in an insufficient amount of pressure accumulated in the hydraulic accumulator 60. Thus, the controller 36 executes a control process discussed below to accumulate pressure in the hydraulic accumulator 60.

When the pressure accumulated in the hydraulic accumulator 60 is reduced to a predetermined pressure, the switch 63 is switched from the first state to the second state, so that a signal is delivered to the controller 36. Based on the detection result, the controller 36 determines that pressure needs to be accumulated in the hydraulic accumulator 60. In accordance with the determination, the controller 36 switches the electromagnetic valve 68 from the first position to the second position. When the electromagnetic valve 68 is switched to the second position, the hydraulic pump 31 and the pressure compensating valve 66 are connected to each other, that is, the oil passage 67 is opened. The controller 36 then controls the load handling motor 30 to activate the hydraulic pump 31 with the load handling levers 18 being unmanipulated. Thus, the hydraulic pressure generated by operation of the hydraulic pump 31 is applied to the pressure compensating valve 66 via the oil passage 67.

FIG. 4B schematically shows operation of the pressure compensating valve 66 when the electromagnetic valve 68 of the pressure compensating circuit 43 is set to the second position. When the electromagnetic valve 68 is set to the second position, the pressure compensating valve 66 receives the pressure indicated by arrow Y1 of a solid line via the oil passage 65 and also a pressure indicated by arrow Y3 of a solid line via the oil passage 67. That is, the pressure that acts along arrow Y3 produces a force that is applied to the pressure compensating valve 66 to disconnect the hydraulic pump 31 and the oil tank 33 from each other, that is, to close the oil passage 65. Thus, the hydraulic pressure generated by operation of the hydraulic pump 31 is not released. That is, the hydraulic oil in the oil passage 65 is not discharged to the oil tank 33, and the hydraulic pressure is maintained. Accordingly, in the hydraulic mechanism 32, the hydraulic pressure generated by operation of the hydraulic pump 31 is not released, so that the hydraulic pressure in the oil passage 34 is increased. As a result, in the hydraulic mechanism 32, the pressure compensating circuit 43 generates hydraulic pressure in the oil passage 53, which is connected to the brake system circuit 42. The generated hydraulic pressure is accumulated in the hydraulic accumulator 60 with the load handling device 21 not being operated. That is, the pressure required to actuate the auxiliary brake devices 50, 51 is accumulated in the hydraulic accumulator 60.

FIG. 5 represents one example of changes in the pressure accumulation state in the hydraulic accumulator 60.

As shown in FIG. 5, when the auxiliary brake devices 50, 51 are actuated in a state in which the pressure required to actuate the auxiliary brake devices 50, 51 are accumulated, the pressure in the hydraulic accumulator 60 is released (point in time t1). As a result, the pressure accumulated in the hydraulic accumulator 60 drops. When the pressure accumulated in the hydraulic accumulator 60 drops below a predetermined pressure (X in the chart), the pressure accumulation state is detected by the switch 63. Accordingly, the controller 36 activates the load handling motor 30 at a point in time t2 (motor ON in the chart) and then switches the electromagnetic valve 68 to the second position at a point in time t3 (valve ON in the chart). This generates pressure in the oil passage 53, which is connected to the brake system circuit 42, so that pressure is accumulated in the hydraulic accumulator 60. Thereafter, when the pressure accumulated in the hydraulic accumulator 60 reaches the predetermined pressure, the pressure accumulation state is detected by the switch 63. Accordingly, the controller 36 stops the load handling motor 30 (motor OFF in the chart) and switches the electromagnetic valve 68 to the first position (valve OFF in the chart).

The present embodiment thus has the following advantages.

(1) When it is necessary to accumulate pressure in the hydraulic accumulator 60, the electromagnetic valve 68 is switched to connect the hydraulic pump 31 and the pressure compensating valve 66 to each other so that fluid can flow. Thus, the hydraulic pressure generated by operation of the hydraulic pump 31 is applied to the pressure compensating valve 66 and produces a force in a direction to disconnect the hydraulic pump 31 and the oil tank 33 from each other, so that hydraulic pressure is not released via the pressure compensating valve 66. That is, the hydraulic oil is not discharged to the oil tank 33 via the pressure compensating valve 66, and the hydraulic pressure is maintained. As a result, hydraulic pressure is generated in the oil passage 53, which connects the hydraulic pump 31 and the brake system circuit 42, which includes the hydraulic accumulator 60, to each other, and the generated hydraulic pressure is used to accumulate pressure in the hydraulic accumulator 60. This maintains the pressure accumulation state of the hydraulic accumulator 60 in a favorable manner.

(2) That is, even in the hydraulic mechanism 32, which includes the closed center type control valves 45, 47, 49 and the pressure compensating valve 66, the pressure accumulation state of the hydraulic accumulator 60 is maintained in a favorable manner, so that the auxiliary brake devices 50, 51 are reliably actuated.

(3) Particularly, even when the load handling device 21 is not operated, the pressure accumulation state of the hydraulic accumulator 60 is maintained in a favorable manner, and the auxiliary brake devices 50, 51 are reliably actuated.

(4) Since the switch 63 directly detects the pressure in the hydraulic accumulator 60, pressure can be accumulated in the hydraulic accumulator 60 at appropriate timing.

(5) Since the brake system circuit 42 has the check valve 56 at a section upstream of the section to which the hydraulic accumulator 60 is connected, the pressure accumulation state of the hydraulic accumulator 60 is properly maintained.

(6) Since the load handling motor 30 is stopped when a predetermined pressure is accumulated in the hydraulic accumulator 60, power is not consumed more than necessary. This improves energy conservation.

The above described embodiment may be modified as follows.

The detector for detecting the pressure accumulation state of the hydraulic accumulator 60 may be a means for detecting whether the auxiliary brake devices 50, 51 are actuated. Detection of actuation of the auxiliary brake devices 50, 51 allows insufficient accumulated pressure amount of the hydraulic accumulator 60 to be indirectly detected. Thus, when the auxiliary brake devices 50, 51 are actuated, the controller 36 may perform the same control procedure as the above illustrated embodiment to accumulate pressure in the hydraulic accumulator 60.

The detector for detecting the pressure accumulation state of the hydraulic accumulator 60 may be a pressure sensor instead of the switch 63. The detection result of the pressure sensor is delivered to the controller 36, which in turn detects whether a predetermined pressure is accumulated in the hydraulic accumulator 60. Based on the result, the controller 36 controls the load handling motor 30 and the electromagnetic valve 68.

When a predetermine pressure is accumulated in the hydraulic accumulator 60, the electromagnetic valve 68 is switched to the first position. In this case, the load handling motor 30 may be allowed to continue operating. Also, after the electromagnetic valve 68 is switched to the first position, the operation of the load handling motor 30 may be stopped.

When the controller 36 controls the hydraulic accumulator 60 to accumulate pressure, the controller 36 may simultaneously or substantially simultaneously activate the load handling motor 30 and switch the electromagnetic valve 68 to the second position.

If pressure needs to be accumulated in the hydraulic accumulator 60 during operation of the load handling device 21, the electromagnetic valve 68 may be switched from the first position to the second position to accumulate pressure in the hydraulic accumulator 60.

On condition that the load handling device 21 is not operated when pressure needs to be accumulated in the hydraulic accumulator 60, the controller 36 may control the load handling motor 30 and the electromagnetic valve 68 to accumulate pressure in the hydraulic accumulator 60.

The load handling device may include an attachment.

The control valves 45, 47, 49 in the load handling system circuit 41 may be electromagnetic valves.

Instructing members for instructing load handling operation do not necessary need to be levers such as the load handling levers 18, but may have another structure. The instructing members may be buttons, for example.

Not limited to reach forklifts, the control procedure of the above illustrated embodiment may be applied to any type of forklift as long as it has a hydraulic brake device.

Therefore, the present examples and embodiments are to be considered as illustrative and not restrictive and the invention is not to be limited to the details given herein, but may be modified within the scope and equivalence of the appended claims.

The invention claimed is:

1. An industrial vehicle comprising:

a hydraulic brake device;

a hydraulic load handling device;

a first hydraulic circuit including a hydraulic accumulator, which is a hydraulic pressure source for the brake device, and a detector, which is configured to detect a pressure accumulation state of the hydraulic accumulator;

a first oil passage, which connects the first hydraulic circuit and a hydraulic pump to each other;

a second hydraulic circuit having a closed center type control valve, which disconnects the hydraulic pump and the load handling device from each other when a load manipulating section is unmanipulated, wherein the second hydraulic circuit switches supply/drainage of hydraulic oil by using the control valve, thereby actuating the load handling device;

a second oil passage, which connects the second hydraulic circuit and the hydraulic pump to each other;

a pressure compensating circuit having a pressure compensating valve and an electromagnetic valve, wherein the pressure compensating valve is located in a third oil passage, which connects the hydraulic pump and the oil tank to each other without the second hydraulic pump, and the electromagnetic valve is located in a fourth oil passage, which connects the hydraulic pump and the pressure compensating valve to each other; and a controller, wherein the electromagnetic valve is configured to be switched between a first position and a second position through control by the controller, wherein, at the first position, the electromagnetic valve disconnects the hydraulic pump and the pressure compensating valve from each other, and, at the second position, the electromagnetic valve connects the hydraulic pump and the pressure compensating valve to each other, the controller is configured to set the electromagnetic valve to the first position during operation of the load handling device, and set the electromagnetic valve to the second position and control an electric motor to drive the hydraulic pump when determining that pressure needs to be accumulated in the hydraulic accumulator based on a detection result of the detector, and when the electromagnetic valve is set to the second position, hydraulic pressure generated by driving the hydraulic pump is applied to the pressure compensating valve and produces a force acting in a direction to disconnect the hydraulic pump and the oil tank from each other, so that hydraulic pressure is generated in the first oil passage to be accumulated in the hydraulic accumulator.

2. The industrial vehicle according to claim 1, wherein the controller detects a pressure as the pressure accumulation state of the hydraulic accumulator based on the detection result of the detector.

3. The industrial vehicle according to claim 1, wherein the first hydraulic circuit further includes a check valve, which maintains the pressure accumulated in the hydraulic accumulator.

4. The industrial vehicle according to claim 1, wherein, when a predetermined pressure is accumulated in the hydraulic accumulator, the controller switches the electromagnetic valve to the first position and stops the electric motor.

5. The industrial vehicle according to claim 1, wherein the brake device is a front wheel brake device for a reach forklift.

* * * * *